US007340793B2

(12) United States Patent
Lee

(10) Patent No.: US 7,340,793 B2
(45) Date of Patent: Mar. 11, 2008

(54) WASHING MACHINE CONTROL METHOD

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 653 days.

(21) Appl. No.: 10/716,502

(22) Filed: Nov. 20, 2003

(65) Prior Publication Data

US 2004/0103069 A1 May 27, 2004

(30) Foreign Application Priority Data

Nov. 26, 2002 (KR) ..... 10-2002-0074063

(51) Int. Cl.
*D06F 39/08* (2006.01)
*D06F 33/02* (2006.01)

(52) U.S. Cl. ..... 8/159

(58) Field of Classification Search ..... 8/158–159; 68/12.05, 12.21
See application file for complete search history.

(56) References Cited

U.S. PATENT DOCUMENTS 2,593,752 A * 4/1952 Haberstump ..... 68/61
4,151,864 A * 5/1979 Thurman ..... 138/106
4,380,243 A * 4/1983 Braley ..... 137/312
4,418,712 A * 12/1983 Braley ..... 137/312
4,696,171 A * 9/1987 Babuin ..... 68/207
5,199,455 A * 4/1993 Dlouhy ..... 137/217
5,592,964 A * 1/1997 Traylor ..... 137/216
5,713,385 A * 2/1998 Traylor ..... 137/216
6,257,027 B1 * 7/2001 Imai ..... 68/12.12
6,360,567 B1 * 3/2002 Lu ..... 68/12.05
6,609,264 B2 * 8/2003 Ruhl et al. ..... 8/158
2003/0154558 A1 * 8/2003 Pyo et al. ..... 8/158

FOREIGN PATENT DOCUMENTS

KR 1997-0027481 9/1998

* cited by examiner

*Primary Examiner*—Joseph L. Perrin
(74) *Attorney, Agent, or Firm*—McKenna Long & Aldridge LLP

(57) ABSTRACT

In a method of controlling to a water supplying step and a water draining step in a washing machine having no anti-siphoning device, an error state is determined when water supplying and water draining are simultaneously performed. The error state is determined for cases where there is no change in water level after supplying water for a predetermined time. In such cases, water is then re-supplied after a complete draining. The method includes steps of (a) sensing an initial level of water remaining in the washing machine; (b) storing in a memory a value indicative of the sensed initial water level if the sensed initial water level exceeds a predetermined substantive amount and executing a first water supplying step; (c) discharging the remaining water from the washing machine, executing a second water supplying step, and sensing a current water level if the sensed initial water level is less than the predetermined substantive amount; (d) determining a water level variation based on the sensed current water level and the stored value; (e) repeating the step (c) if the determined water level variation continues to be less than a predetermined value for a first predetermined time period; (f) displaying an internal error if the determined water level variation continues to be less than the predetermined value after a predetermined number of repetitions of the step (e); and (g) executing a user-selected washing step if the determined water level variation exceeds the predetermined value.

6 Claims, 2 Drawing Sheets

WASHING MACHINE CONTROL METHOD

This application claims the benefit of Korean Application No. 10-2002-0074063 filed on Nov. 26, 2002, which is hereby incorporated by reference.

BACKGROUND OF THE INVENTION

1. Field of the Invention

The present invention relates to a washing machine, and more particularly, to a method of controlling a water supplying step and a draining step in a washing machine having no anti-siphoning device.

2. Discussion of the Related Art

In general, a washing machine is an apparatus for removing dirt from laundry through such steps as washing, rinsing, and dewatering in accordance with a program stored in a microcomputer under the control of a user. Basically, a tub is filled with water for carrying out a washing step or a rinsing step, which is drained using a drain pump after each step to permit refilling for further washing or rinsing steps. The drain pump, installed in a is drainpipe for draining the tub to the exterior of the washing machine, is turned off when draining is finished.

In a washing machine as above, there is an inherent siphonic phenomenon that may occur with draining, whereby an unintended continuation of a draining step persists even if the drain pump is turned off. Thus, if an attempt to refill the tub is initiated immediately following the draining, by way of the stored program or otherwise, the siphonic phenomenon may continue to drain the tub while filling progresses. That is, if water remains in the drainpipe of the washing machine as the draining step comes to an end, a siphonic phenomenon will tend to continue to act on the remaining water, to counter a refilling of the tub in the event that a subsequent user-selected step, such as washing or rinsing, is performed.

To prevent the occurrence of such a phenomenon, a washing machine may be provided with an anti-siphoning device. Such devices, however, are expensive and are thus cost-prohibitive for the manufacture of an ordinary consumer product such as a home appliance. In a washing machine without such an anti-siphoning device, water is wasted and the refilling process may be slowed accordingly. Moreover, if a substantial amount of water remains when a subsequent user-selected step is to be executed, for example, due to the counterproductive refilling of water simultaneous with its draining, a simple draining of the water may also unnecessarily waste water.

SUMMARY OF THE INVENTION

Accordingly, the present invention is directed to a washing machine control method that substantially obviates one or more of the problems due to limitations and disadvantages of the related art.

An object of the present invention, which has been devised to solve the foregoing problem, lies in providing a washing machine control method, by which a siphonic phenomenon is avoided without the use of an anti-siphoning device.

It is another object of the present invention to provide a washing machine control method which prevents a simultaneous execution of water draining and water supplying.

It is another object of the present invention to provide a washing machine control method which conserves water by avoiding an unnecessary wasting of water.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a method of controlling a washing machine. The method comprises steps of sensing a current level of water remaining in the washing machine; discharging the remaining water from the washing machine if the sensed water level exceeds a predetermined substantive amount; re-supplying water to the washing machine upon determining that the water discharging step has been completed; and executing a washing step when a predetermined water level is reached by the water re-supplying step.

Alternatively, the method of the present invention may comprise steps of (a) sensing an initial level of water remaining in the washing machine; (b) storing in a memory a value indicative of the sensed initial water level if the sensed initial water level exceeds a predetermined substantive amount and executing a first water supplying step; (c) discharging the remaining water from the washing machine, executing a second water supplying step, and sensing a current water level if the sensed initial water level is less than the predetermined substantive amount; (d) determining a water level variation based on the sensed current water level and the stored value; (e) repeating the step (c) if the determined water level variation continues to be less than a predetermined value for a first predetermined time period; (f) displaying an internal error if the determined water level variation continues to be less than the predetermined value after a predetermined number of repetitions of the step (e); and (g) executing a user-selected washing step if the determined water level variation exceeds the predetermined value.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

According to the present invention, in controlling a water supplying step and a draining step of a washing machine, a water level is sensed to determine whether a substantive amount of water remains in a washing machine. If so, the remaining water is completely drained. Water is then newly supplied to the washing machine.

Figure 1:
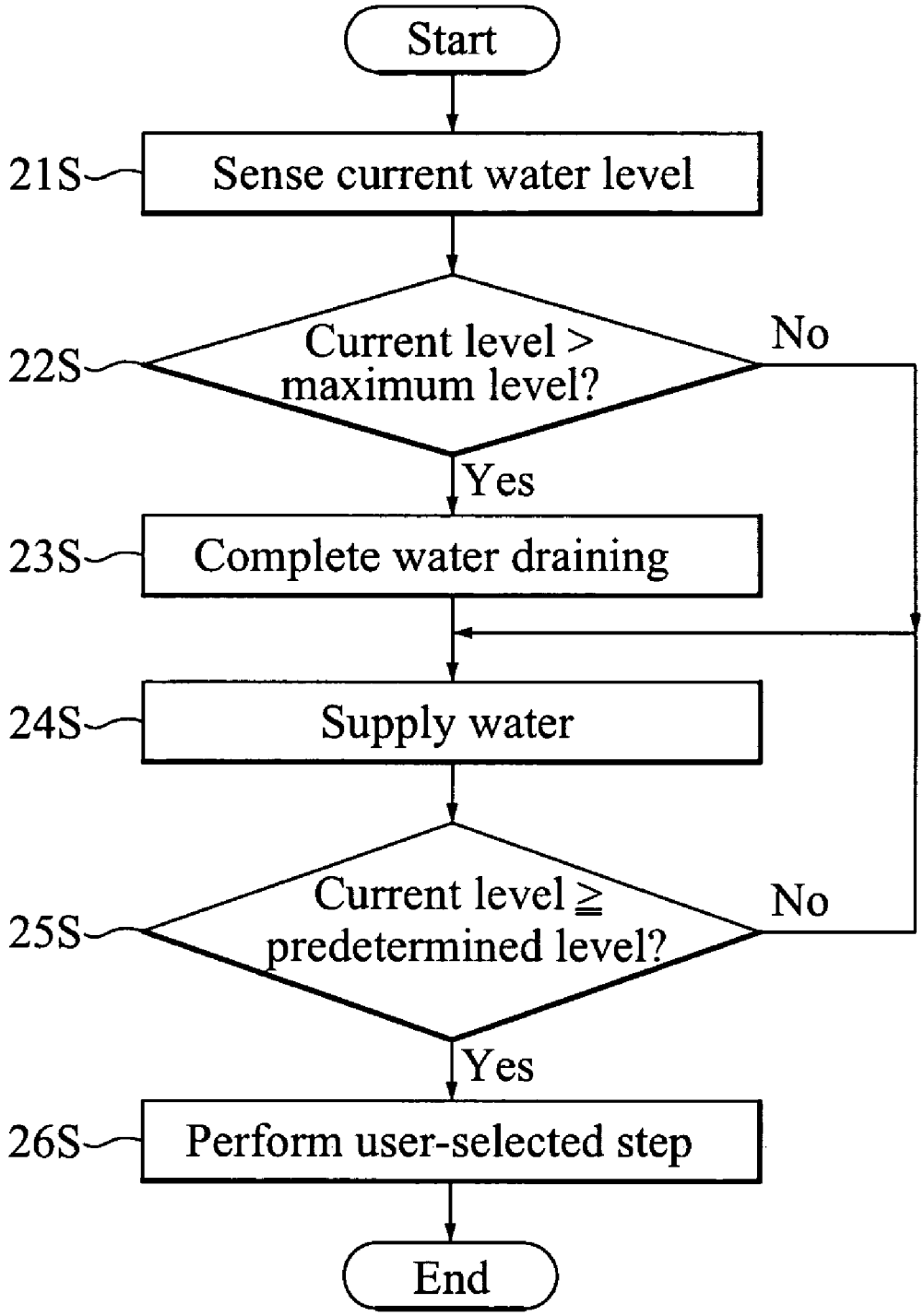
FIG. 1 is a flowchart of a washing machine control method according to a first embodiment of the present invention, to control a water supplying and a draining step in a conventional washing machine.

Referring to FIG. 1, a method according to a first embodiment of the present invention is comprised of a step 21S for sensing a current water level in a washing machine, a step 22S for determining whether the sensed level exceeds a predetermined maximum level, a step 23S for completely draining the washing machine, a step 24S for supplying water to the washing machine, a step 25S for determining whether the sensed level has reached a predetermined level for executing a user-selected step, and a step 26S for executing the user-selected step.

In detail, the washing machine is turned on, and it is first determined whether water remains in the washing machine, by sensing a current water level (21S) to determine whether the current water level exceeds a predetermined maximum level (22S). If so, draining is performed to discharge the remaining water completely (23S). If, on the other hand, the current water level is lower than the predetermined maximum level water amount, it is determined that optimum draining has been achieved. In this case, a water supplying step is executed (24S), which continues until a predetermined level for executing the user-selected step is reached (25S), whereupon the user-selected step is executed (26S).

Accordingly, the first embodiment of the present invention prevents a simultaneous execution of water draining and water supplying, which may occur due to the siphonic phenomenon. In this embodiment, any amount of water remaining in the washing machine is completely drained (discharged). To enable the use of substantive amounts of remaining water, however, the second embodiment of the present invention provides a method, illustrated in FIG. 2, in which the remaining water, whatever level, is used without a complete draining thereof.

Figure 2:
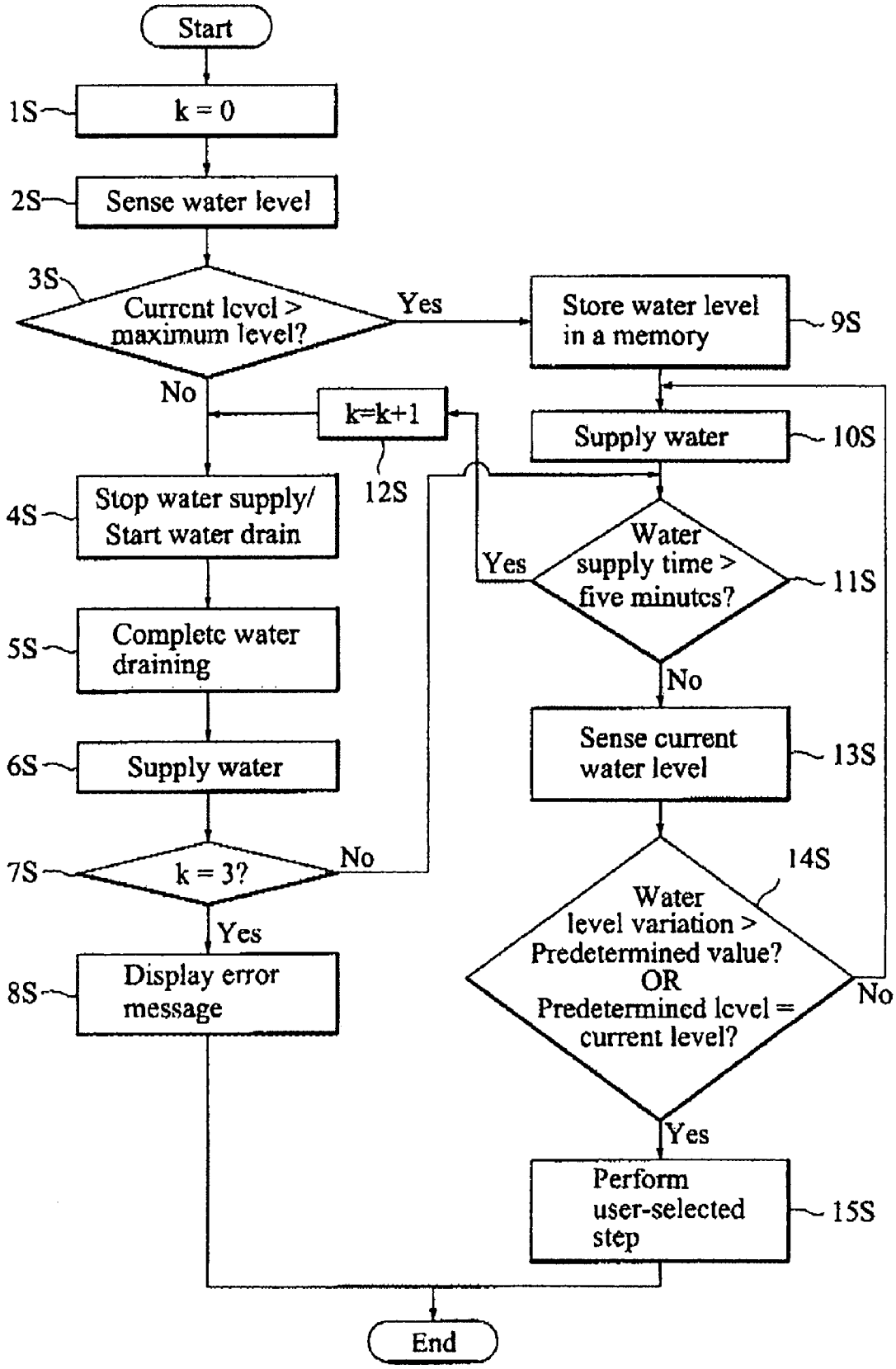
FIG. 2 is a flowchart of a washing machine control method according to a second embodiment of the present invention, to control a water supplying and a draining step in a conventional washing machine.

Referring to FIG. 2, a counter k is initialized (k=0) in a step 1S, and an initial water level in a washing machine is sensed in a step 2S, to determine in a step 3S whether the initial water level exceeds a predetermined substantive amount of remaining water. If so, a value indicative of the initial water level is stored in a step 9S in a memory for a later comparison, and a water supplying step is initiated in a step 10S. If not, the supply of water to the tub is stopped in a step 4S whereupon draining is performed for a predetermined time (e.g., about twenty seconds) in a step 5S, which is deemed sufficient to achieve a thorough draining. Thereafter, water is re-supplied in a step 6S, which continues, until the expiration of a predetermined time (e.g., about five minutes) as determined by a step 11S while sensing a current water level in a step 13S.

If, in step 14S, as the resupply of water continues, the sensed water level of the step 13S indicates an excessive water level variation with respect to the stored value, i.e., a variation greater than a predetermined value, or if the current water level reaches a desired level, a user-selected washing step is executed in a step 15S. Here, a relatively low variation in water level would indicate the presence of a siphonic phenomemon.

On the other hand, if both conditions of the step 13S remain untrue even after the expiration of the predetermined time, the value of the counter is incremented (k=k+1) in a step 12S and the above steps 4S~6S are repeated to stop the water supply, complete a draining step, and begin the water supply anew. If this condition persists after repeated attempts (e.g., about three times) according to a step 7S, an internal error is determined in a step 8S.

Accordingly, in the second embodiment of the present invention, a water re-supplying step is performed anew only if the water level initially exceeds a predetermined substantive amount and a draining step is interrupted by a siphonic phenomenon. Hence, the use of an amount of water remaining in the washing machine is possible, and an unnecessary draining of water is prevented.

By adopting the washing machine control method according to the present invention, a substantive level of water is detected in a washing machine having no anti-siphoning device, the remaining water is completely discharged, and then a water supplying step is executed, thus preventing a siphonic phenomenon resulting in an unnecessary wasting of water due to a counterproductive action of simultaneously supplying and draining water. As an alternative, the water supplying step may be executed immediately if substantive amounts of water remain, through a determination of whether a siphonic phenomenon is present by simultaneously detecting variations in the water level in addition to detecting the water level itself. If the siphonic phenomenon is determined to be present, a user-selected step is proceeded by simply adding water to the current level and thereby conserving the remaining water.

It will be apparent to those skilled in the art that various modifications and is variations can be made in the present invention without departing from the spirit or scope of the invention. Thus, it is intended that the present invention cover such modifications and variations, provided they come within the scope of the appended claims and their equivalents.

What is claimed is:

1. A method of controlling a washing machine, comprising steps of:

(a) sensing an initial level of water in the washing machine;

(b) storing in a memory a value indicative of the sensed initial water level if the sensed initial water level exceeds a predetermined substantive amount and executing a first water supplying step;

(c) discharging the water from the washing machine, executing a second water supplying step, and sensing a current water level if the sensed initial water level is less than the predetermined substantive amount;

(d) determining a water level variation based on the sensed current water level and the stored value;

(e) repeating said step (c) if the determined water level variation continues to be less than a predetermined value for a first predetermined time period;

(f) displaying an internal error if the determined water level variation continues to be less than the predetermined value after a predetermined number of repetitions of said step (e); and (g) executing a user-selected washing step if the determined water level variation exceeds the predetermined value.

2. The method as claimed in claim 1, further comprising a step of executing the user-selected washing step if the sensed current water level reaches a desired level.

3. The method as claimed in claim 1, wherein the discharging of said step (c) is achieved by draining the remaining water from the washing machine for a second predetermined time period.

4. The method as claimed in claim 3, wherein the second predetermined time period is at least twenty seconds.

5. The method as claimed in claim 1, wherein the first predetermined time period is substantively five minutes.

6. The method as claimed in claim 1, wherein the predetermined number of repetitions is less than four.

* * * * *